US006027349A

United States Patent [19]

Chang

[11] Patent Number: 6,027,349

[45] Date of Patent: Feb. 22, 2000

[54] ELECTRICAL CONNECTOR

[75] Inventor: Bao Shu Chang, Hsinchung, Taiwan

[73] Assignee: Hung Yueh Chang, Taipei Hsien, Taiwan

[21] Appl. No.: 09/116,300

[22] Filed: Jul. 15, 1998

[51] Int. Cl.[7] ..... H01R 3/00

[52] U.S. Cl. ..... 439/101; 439/607

[58] Field of Search ..... 439/101, 607–610

[56] References Cited

U.S. PATENT DOCUMENTS 5,556,301 9/1996 Chishima et al. ..... 439/507

5,711,686 1/1998 O'Sullican et al. ..... 439/610

5,797,757 8/1998 Aoki ..... 439/101

*Primary Examiner*—Lincoln Donovan

*Attorney, Agent, or Firm*—Pro-Tehctor International Services

[57] ABSTRACT

An electrical connector includes a metal casing, a plurality of axially extended grounding terminals and a plurality of axially extended signal terminals embedded in the metal casing, wherein a metal spring plate is fastened to the grounding terminals, enabling the grounding terminals to be connected to the ground by an electric lead wire.

1 Claim, 5 Drawing Sheets

ELECTRICAL CONNECTOR

BACKGROUND OF THE INVENTION

The present invention relates to an electrical connector in which a metal spring plate is fastened to equiangularly spaced grounding terminals, enabling the grounding terminals to be connected to the ground by an electrical lead wire.

FIG. 1 shows an electrical connector according to the prior art. This structure of electrical connector comprises a metal casing 10, a plurality of axially extended grounding terminals 11 and a plurality of axially extended signal terminals 12 embedded in the metal casing 10. The grounding terminals 11 and the signal terminals 12 are insulated from one another and protrude from one end of the metal casing 10. The grounding terminals 11 are equiangularly arranged around the longitudinal central axis of the metal casing 10 for connection to the ground. Because the grounding terminals 11 are separated from one another, separate electrical lead wires 13 must be used and respectively fastened to the grounding terminals 11 for connecting the grounding terminals 11 to the ground.

SUMMARY OF THE INVENTION

According to one aspect of the present invention, the electrical connector comprises a metal spring plate fastened to the equiangularly spaced grounding terminals thereof, enabling the grounding terminals to be connected to the ground by an electrical lead wire. According to another aspect of the present invention, the metal spring plate is a C-shaped retainer means, that can be conveniently compressed and inserted into the space surrounded by the equiangularly spaced grounding terminals, enabling peripheral notches thereof to be forced into engagement with the periphery of the grounding terminals by a spring force when it is released.

BRIEF DESCRIPTION OF THE DRAWINGS

FIG. 3–1 is an enlarged view of a grounding terminal for the electrical connector according to the present invention.

DETAILED DESCRIPTION OF THE PREFERRED EMBODIMENT

Figures 1, 3:
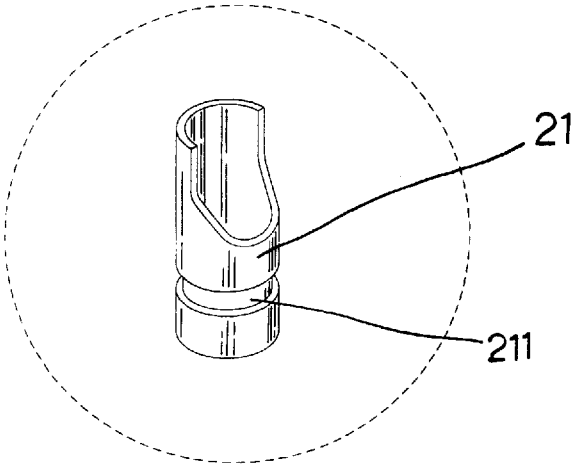
FIG. 3 is an exploded view of the present invention.
Figure 3:
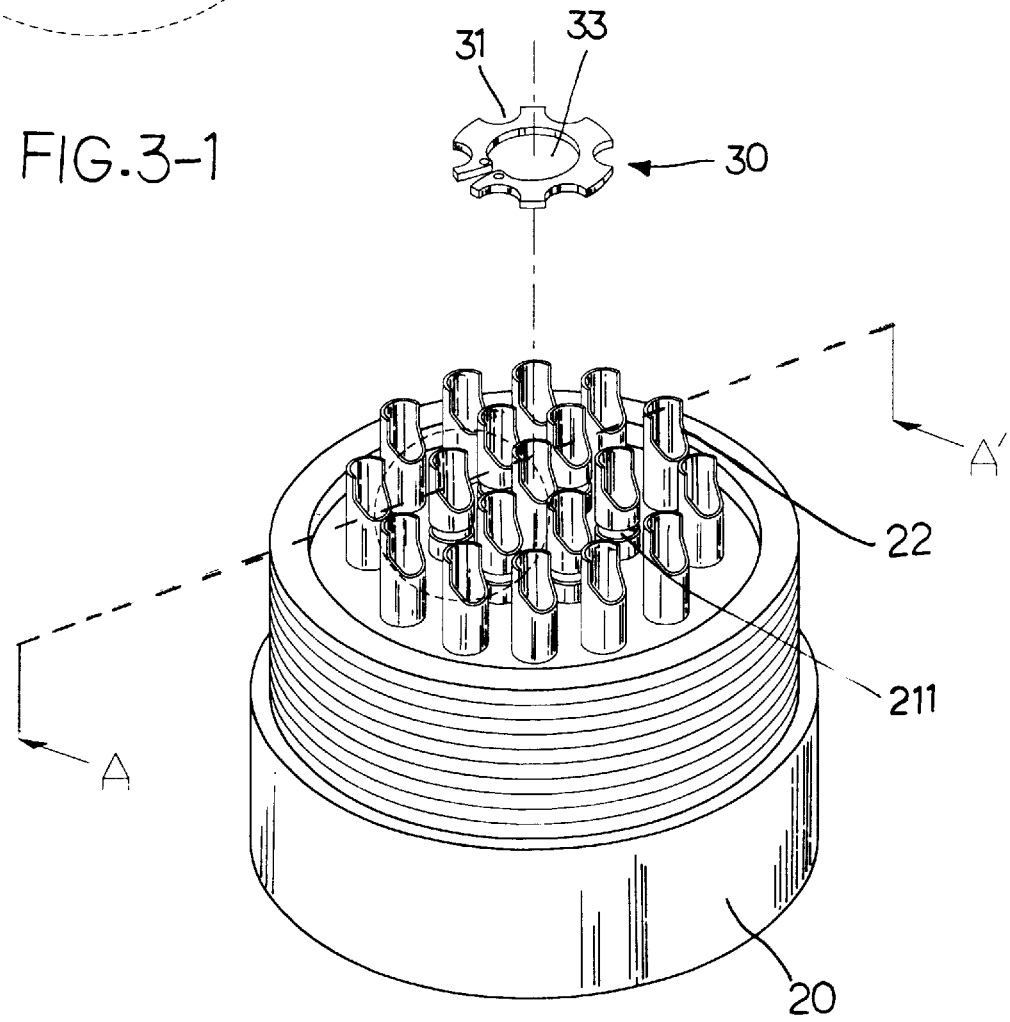

Referring to FIG. 3 , an electrical connector in accordance with the present invention comprises a metal casing 20, a plurality of axially extended grounding terminals 21 and a plurality of axially extended signal terminals 22 embedded in the metal casing 20. The grounding terminals 21 and the signal terminals 22 are insulated from one another, and protrude from one end of the metal casing 20. The grounding terminals 21 are equiangularly arranged around the longitudinal central axis of the metal casing 20 for connection to the ground. The signal terminals 22 are equiangularly spaced around the grounding terminals 21 for connection to the load. According to the present preferred embodiment, the number of the grounding terminals 21 is 6.

Figure 2:
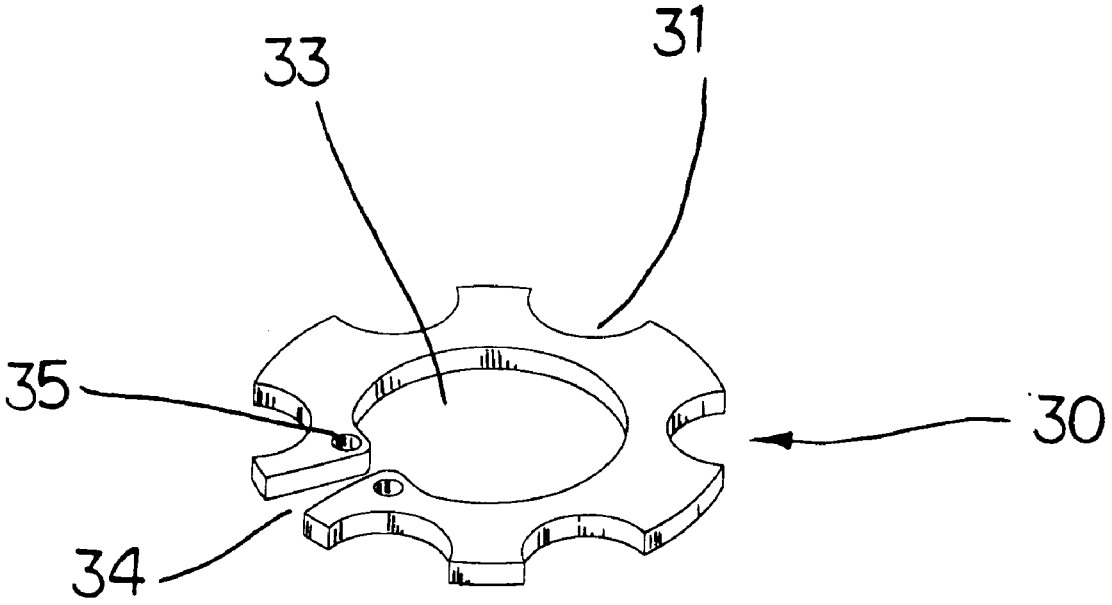
FIG. 2 is a perspective view of a metal spring plate for an electrical connector according to the present invention.
Figure 4:
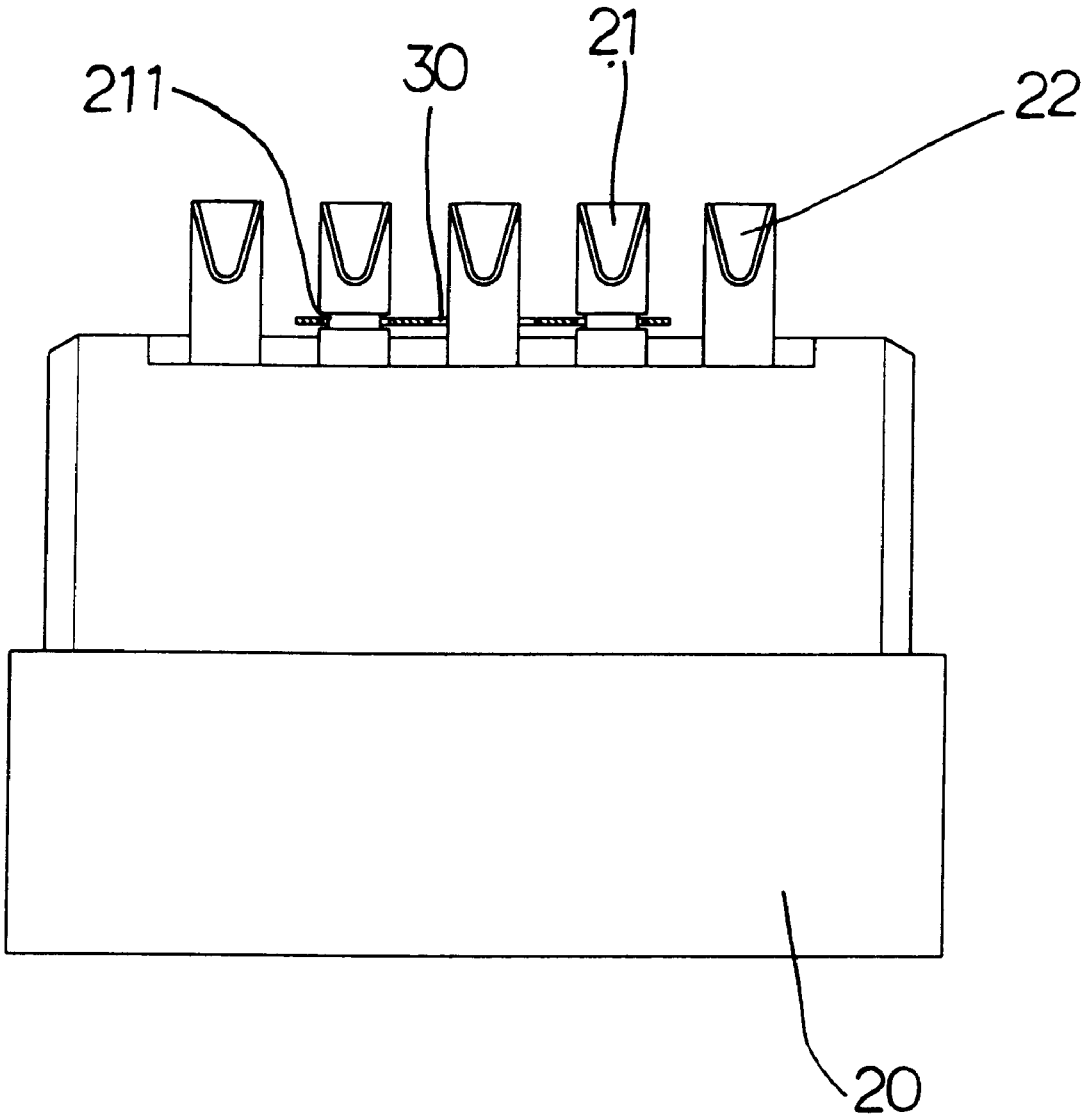
FIG. 4 is a sectional view taken along line A—A of FIG. 3 but showing the metal spring plate installed.

Referring to FIGS. 2 and 4 and FIG. 3 again, a metal spring plate 30 is fastened to the grounding terminals 21, and retained in contact with the grounding terminals 21 electrically. The metal spring plate 30 comprises a center hole 33, a split 34 extended from the center hole 33 to the border, a plurality of peripheral notches 31 equiangularly spaced around the border corresponding to the grounding terminals 21, and two tool holes 35 spaced from the split 34 at two opposite sides. The metal spring plate 30 is made from a resilient metal plate by stamping. Because of the design of the center hole 33 and the split 34, the metal spring plate 30 works as a C-shaped retainer. Through the tool holes 35, the metal spring plate 30 can be compressed with a tool to close the split 34, enabling the metal spring plate 30 to be inserted in the space surrounded by the grounding terminals 21. When the metal spring plate 30 is released, the spring power of the metal spring plate 30 immediately returns the metal spring plate 30 to its former shape, thereby causing the periphery notches 31 to be forced into engagement with the grounding terminals 21.

Figure 1:
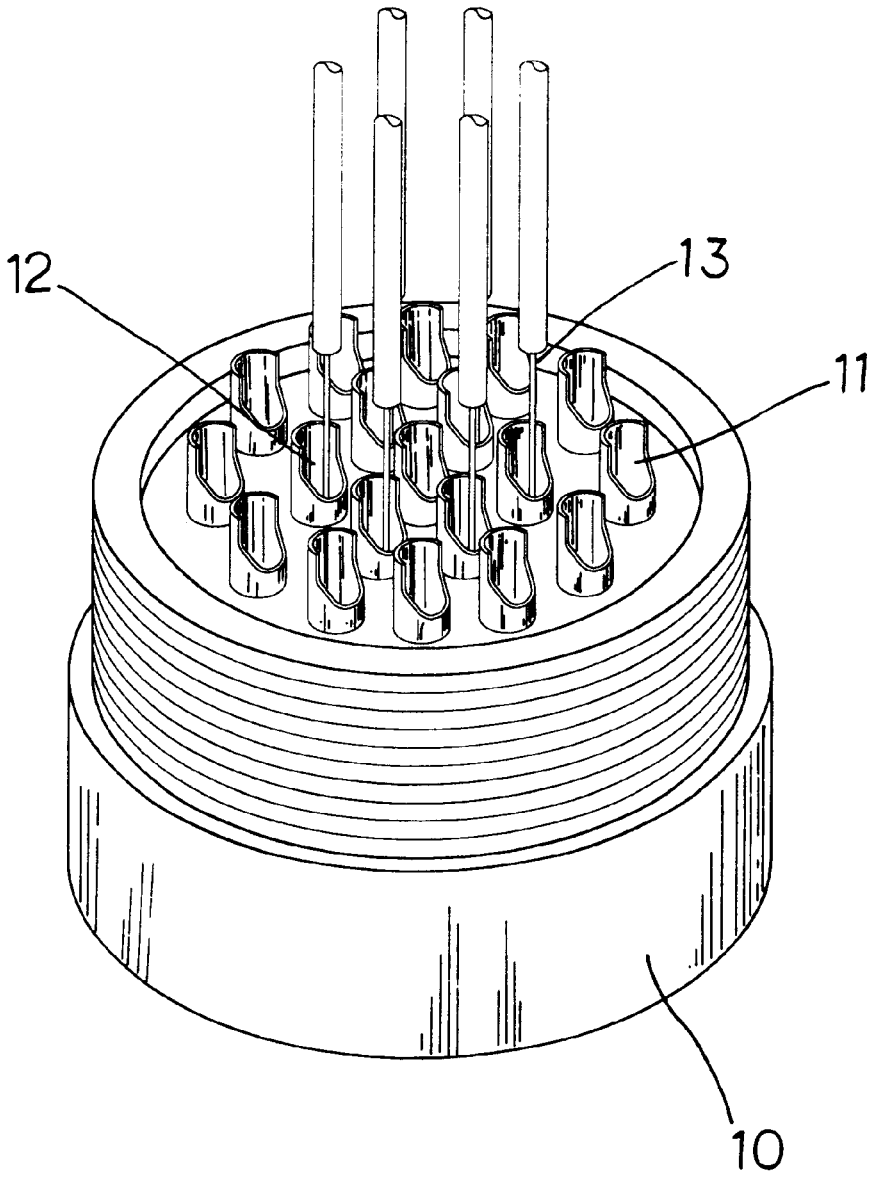
PRIOR ART FIG. 1
FIG. 1 is a perspective view of an electrical connector according to the prior art.

Referring to FIGS. 3–1 and FIGS. 3 and 4 again, each grounding terminal 21 has an annular coupling groove 211 around the periphery for engagement with one peripheral notch 31 of the metal spring plate 30. When the metal spring plate 30 has been inserted into position and released, the peripheral notches 31 of the metal spring plate 30 are forced into engagement the annular coupling grooves 211 of the grounding terminals 21 respectively, and therefore the grounding terminals 21 and the metal spring plate 30 are connected together.

Figure 5:
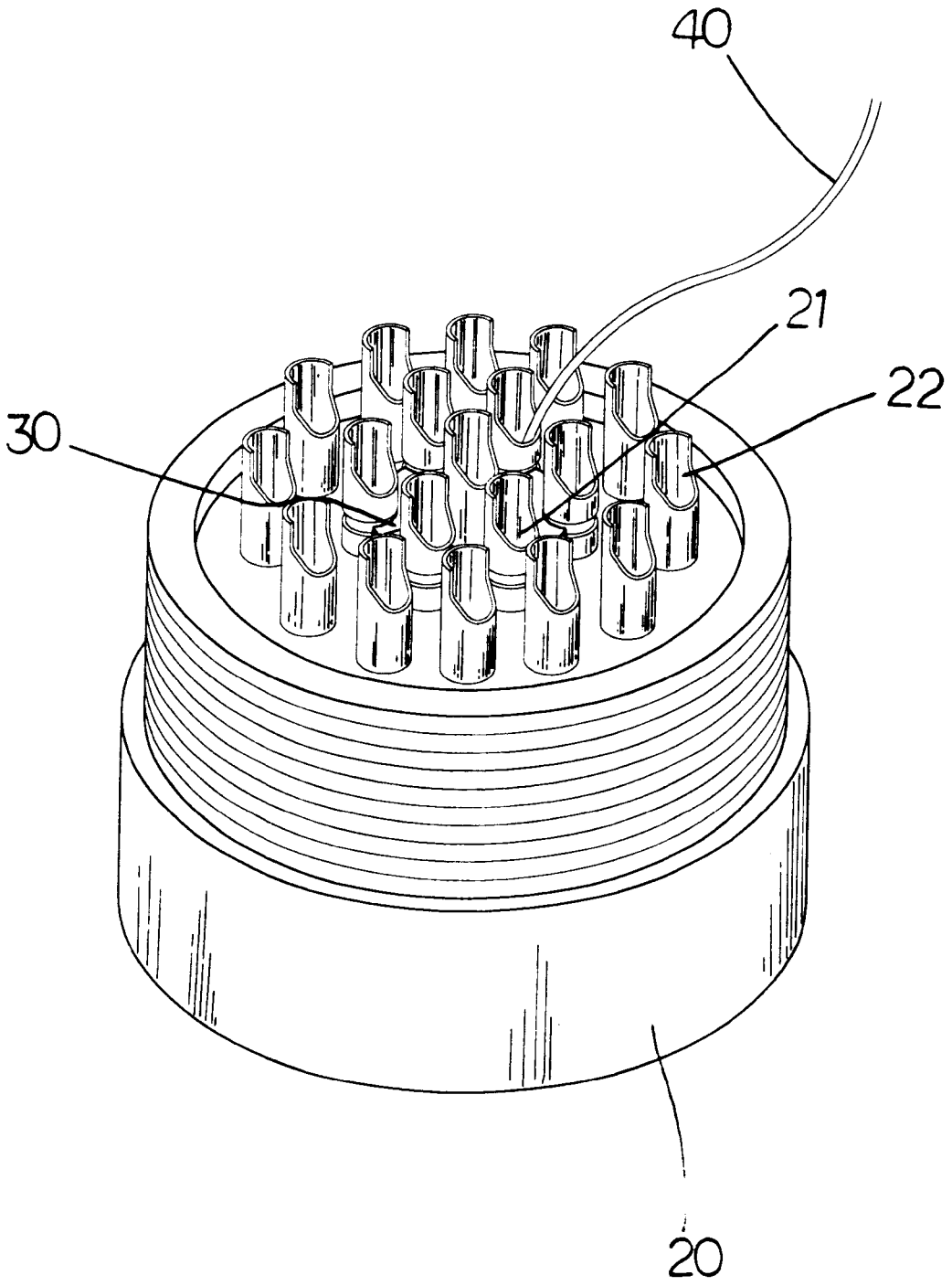
FIG. 5 is an assembly view of FIG. 3.

Referring to FIG. 5, an electric lead wire 40 is connected to one grounding terminal 21 for connection to the grounding terminal of the load. Because the grounding terminals 21 of the electrical connector are connected together by the metal spring plate 30, the grounding terminals 21 can be connected to the grounding terminal of the load by the electric lead wire 40.

While only one embodiment of the present invention has been shown and described, it will be understood that various modifications and changes could be made there unto without departing from the spirit and scope of the invention disclosed.

What the invention claimed is:

1. An electrical connector comprising:

a cylindrical metal casing with a plurality of axially extended grounding terminals and a plurality of axially extended signal terminals secured in said metal casing such that said grounding terminals are electrically isolated from said signal terminals, and a resilient metal spring plate fastened to said grounding terminals enabling said grounding terminals to be connected to ground by an electric lead wire, wherein said grounding terminals are equiangularly spaced around a longitudinal central axis of said metal casing and are surrounded by said signal terminals, and said metal spring plate is mounted in a space surrounded by said grounding terminals such that a periphery of said metal spring plate is retained in contact with said grounding terminals via a plurality of peripheral notches on said metal spring plate that engage said grounding terminals, said metal spring plate has a center hole and a split radially extended from said center hole to a border thereof, and said metal spring plate includes a means to receive a spreading tool to enable a user to temporarily spread said metal spring plate for installation, and said grounding terminals each have an annular coupling groove to engage the peripheral notches of said metal spring plate.

* * * * *